US006959787B2

(12) United States Patent
Husmann

(10) Patent No.: US 6,959,787 B2
(45) Date of Patent: Nov. 1, 2005

(54) ELEVATOR CAR FRAME VIBRATION DAMPING DEVICE

(75) Inventor: Josef Husmann, Lucerne (CH)

(73) Assignee: Inventio AG, Hergiswill (CH)

( * ) Notice: Subject to any disclaimer, the term of this patent is extended or adjusted under 35 U.S.C. 154(b) by 170 days.

(21) Appl. No.: 10/383,186

(22) Filed: Mar. 6, 2003

(65) Prior Publication Data

US 2003/0226717 A1 Dec. 11, 2003

(30) Foreign Application Priority Data

Mar. 7, 2002 (EP) ..... 02405174

(51) Int. Cl.[7] ..... B66B 1/34
(52) U.S. Cl. ..... 187/292; 318/623
(58) Field of Search ..... 187/292, 393, 187/391, 409, 410, 116, 611, 623; 318/116, 611, 623

(56) References Cited

U.S. PATENT DOCUMENTS 4,030,570 A * 6/1977 Caputo ..... 187/292
4,699,348 A 10/1987 Freudenberg
5,027,925 A 7/1991 Kahkipuro
5,117,946 A 6/1992 Traktovenko et al.
5,294,757 A * 3/1994 Skalski et al. ..... 187/393
5,308,938 A 5/1994 Roberts et al.
5,322,144 A 6/1994 Skalski et al.
5,368,132 A * 11/1994 Hollowell et al. ..... 187/393
5,811,743 A * 9/1998 Kohara et al. ..... 187/393
5,896,949 A 4/1999 Hamdy et al.
6,364,064 B1 * 4/2002 Rizzi ..... 187/292

FOREIGN PATENT DOCUMENTS

EP 0 525 812 2/1993
EP 0 731 051 9/1996

* cited by examiner

*Primary Examiner*—Jonathan Salata
(74) *Attorney, Agent, or Firm*—Buteel Long

(57) ABSTRACT

A device for active vibration damping dampens the structural resonance of an elevator car frame with a car body through measurement of the deformation of the frame. Under elastic deformation, a safety plank and a crosshead of the frame move parallel and relative to each other and two acceleration sensors aligned vertically (in the "z" direction) capture the movement. From the difference between the sensor signals, the "y" rotation of the safety plank and the crosshead is determined. The rotation and the signals from acceleration sensors on the frame are used to determine the shear movement of the frame.

14 Claims, 3 Drawing Sheets

ELEVATOR CAR FRAME VIBRATION DAMPING DEVICE

BACKGROUND OF THE INVENTION

The present invention relates to a device for damping vibrations of a frame that is guided on guiderails by means of guide elements and carries an elevator car body. Vibrations that occur perpendicular to the direction of travel are measured by acceleration sensors fastened to the frame, and are used to control at least one actuator arranged between the frame and the guide elements, the actuator acting simultaneously with, and in the opposite direction to, the vibrations.

The European patent specification EP 0 731 051 B1 shows a method and a device by which vibrations of an elevator car, which is guided on rails, occurring perpendicular to the direction of travel are reduced by means of a feedback control acting in the high-frequency range, so that the vibrations are not perceptible in the car. For the purpose of capturing the measurement values, inertia sensors are fastened to the car frame. In the event of a one-sided inclination of the car relative to the rails, a position controller acting in the low-frequency range guides the car automatically back into a central position so that an adequate damping distance is always available. Position sensors deliver the measurement values to the position controller. Actuators are provided with linear motors to adjust the position of the rollers. On each roller guide, a first linear motor controls two side rollers, and a second linear motor controls the middle roller. The cost for such equipment for executing the method is low, since the two control loops are combined into a common feedback control, and act on one actuator.

A disadvantage of this known device is that the elevator itself must have a rigid structure in order that the ride comfort is assured by the vibration control.

SUMMARY OF THE INVENTION

The present invention concerns a device for damping vibrations of an elevator car frame carrying a car body and guided by guide elements on guiderails comprising: an elevator car frame; at least one acceleration sensor fastened to said car frame and being responsive to vibrations which occur perpendicular to the direction of travel of said car frame for generating a feedback signal; at least one actuator arranged between said car frame and the guide elements and acting in the opposite direction to the vibrations in response to said feedback signal; a sensing means for sensing a shear movement of said car frame and generating a sensor signal representing a value of the shear movement; and a control device connected to said sensing means and responsive to said sensor signal for generating an actuating signal to the at least one actuator for controlling the shear movements of said car frame. The sensing means includes one of acceleration sensors, wire strain gages, a laser sensor system and a fiber optic gyro attached to said car frame for generating said sensor signal. The control device includes at least one controller responsive to said sensor signal for generating said actuating signal and at least one current amplifier responsive to said actuating signal for generating a current to the at least one actuator, whereby said current is proportional to a force to be generated by the at least one actuator.

The device according to the present invention provides a solution to avoiding the disadvantages of the known device with a vibration feedback control that takes into account the elastic properties of the frame with the car body.

An elevator car (frame and car body) has a very elastic structure, especially in the horizontal direction. Typically, the first resonant frequency of the structure lies in the region of 10 Hz for elevator cars with optimized rigidity of the frame and of the car isolation, and otherwise the resonant frequency of the structure is even lower. The difference from the frequencies to be damped is very low, and limits the effect of the active vibration damping, since the latter cannot damp the structure resonance itself. This only becomes possible when a sufficiently good measurement of the state of the car deformation, especially the phase position, is available.

In principle, it is better to construct the elevator car (frame and car body) very stiffly, so that it behaves essentially as a rigid body. No measurements of the elastic deformation are then necessary. However, this objective can only be achieved with new elevator cars for high buildings.

Existing elevator cars (frame and car body) can only be stiffened to a limited extent with reasonable outlay. Otherwise it is more practicable to use a new elevator car (frame and car body) with a rigid type of construction. Measurement of the deformation extends the range of application of active vibration damping to structurally less suitable elevator cars, which today account for the majority of all elevator cars in use.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
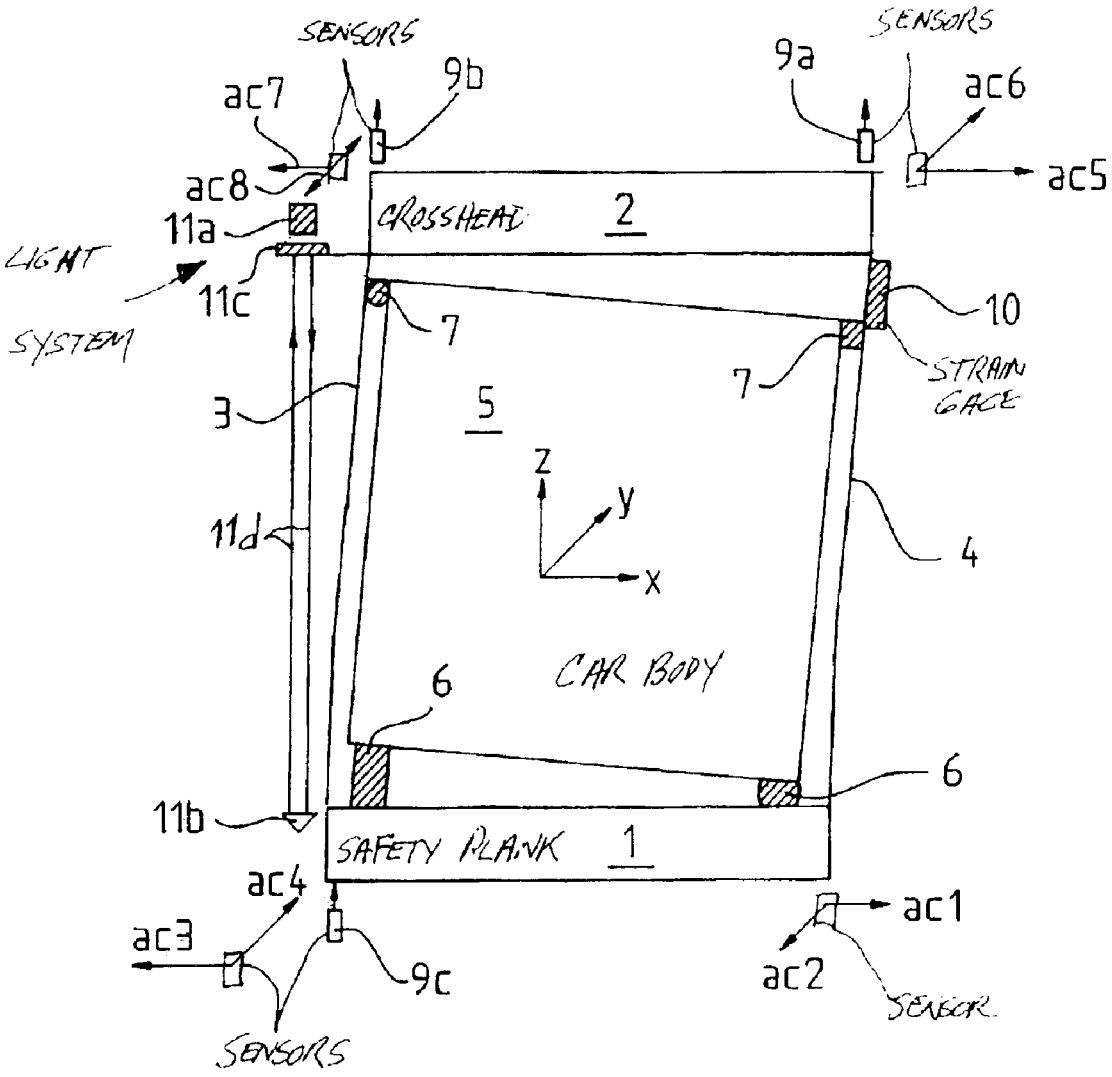
FIG. 1 is a schematic representation of the arrangement of the sensors of a device for damping shearing movements of an elevator car frame with a car body according to the present invention.

As shown in FIG. 1, the greatest elastic deformation is a shearing in an "x" direction of a car frame carrying a car body 5. The frame includes a safety plank 1 below the car body 5 and a crosshead 2 above. A first side stile 3 and a second side stile 4 extend between the safety plank 1 and the crosshead 2. The crosshead 2 is, for example, connected to a suspension rope (not shown) which is, for example, guided over a traction sheave (not shown. Arranged on the crosshead 2 and the safety plank 1 are guide elements (not shown) which guide the frame along the guiderails (not shown) arranged in the elevator hoistway (not shown) extending in a "z" direction.

When elastic deformation occurs, the safety plank 1 and the crosshead 2 move parallel and relative to each other. This deformation cannot be measured with a plurality of acceleration sensors ac1 to ac8 according to the prior art elevator system described above, which sensors measure perpendicularly to the direction of travel of the elevator car comprising the car frame and the car body 5, because no differentiation can be made between rotation of the car body 5 about a "y" axis and shearing movement of the frame in the "x" direction. In view of this, an additional measurement is necessary. Possible embodiments for measuring the deformation are:

1. Provide two acceleration sensors 9*a* and 9*b* (or 9*c* as alternative to 9*b*) aligned vertically (in the "z" direction) with a large distance between their sensing axes. From the difference between the sensor signals, the "y" rotation of the safety plank 1 and the crosshead 2 is determined. Together with the signals from the acceleration sensors ac1 or ac3, and ac5 or ac7, the shearing movement of the frame can be determined. Instead of the vertically aligned acceleration sensors 9*a*, 9*b* and 9*c*, a sensor can also be used which measures the rate of twisting sufficiently accurately, for example a fiber optic gyro, or horizontally aligned acceleration sensors fastened on either the safety plank 1 or the crosshead 2 with sufficient distance between their sensing axes.

2. Use a light system such as a commercially available fiber optic gyro having a light source 11*a* whose light beam is emitted into an optical fiber. The light beam is split into two part-beams 11*d*, which pass in opposite directions through a coil formed by the optical fiber. The two part-beams are then brought together again at a receiver 11*c*, resulting in interference between them. If the coil of optical fiber rotates, one part of the beam must travel a slightly longer distance than the other part, which causes a shift in phase and therefore a change in the amount of interference.

3. Measurement of the deformation of the frame can be made with wire strain gages 10. These gages are fastened on the first side stile 3, or on the second side stile 4, at the point with the greatest flexural deformation. The behavior of the latter is proportional to the shearing movement of the frame.

4. Measurement of the shearing movement of the frame can be made by a light system such as a laser sensor system having a laser as the light source 11*a*, a reflector prism 11*b*, and a photo-sensitive line sensor as the receiver 11*c*. An arrangement without the reflector prism is possible. Advantages of the arrangement with the reflector prism are that accurate alignment is not necessary, all active components are on one side, and the resolution of the measurement is doubled.

To provide information about distance, the signals of the acceleration sensors have to be integrated twice, which is associated with drift and/or measurement errors. To provide information about distance, the signal of the fiber optic gyro has to be integrated once, which is also associated with drift and/or measurement errors. The optical measurement device (laser) is quite elaborate. Moreover, it is difficult to arrange it spatially in a manner which is not subject to disturbance. With modem wire strain gages, very small extensions can be measured. Measurement of the shearing takes place directly, without the aid of further sensors. The use of wire strain-gage technology for measurement of the shear is promising.

Figure 2:
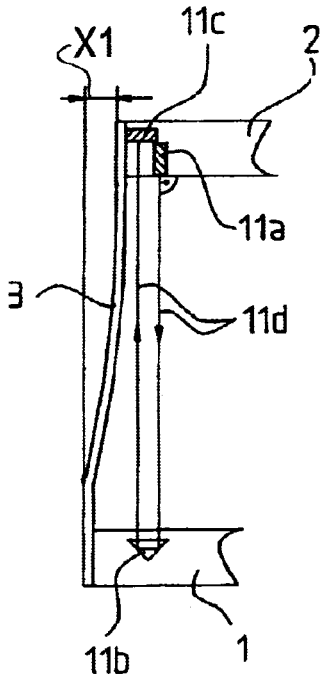
FIG. 2 is a schematic representation of the measuring device shown in FIG. 1 for measuring the shearing movements of a car frame by means of a laser.
Figure 2A:
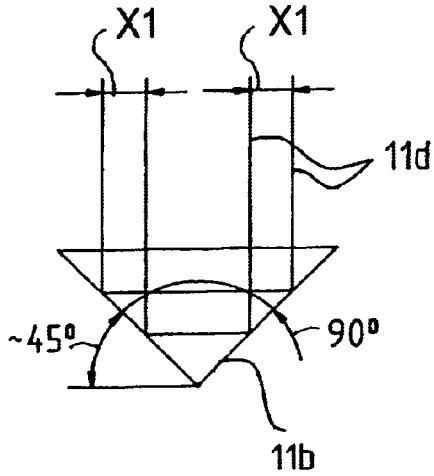
FIG. 2*a* shows details of the measuring device according to FIG. 2.

When the frame shears, the safety plank 1 and the crosshead 2 move parallel and relative to each other by an amount X1 (FIG. 2) along the "x" axis. Fastened to the crosshead 2 is the laser 11*a*, which generates preferably infrared light and emits a sharply bundled beam 11*d* vertically downward. Fastened on the safety plank 1 is the optical prism 11*b*, which reflects the light beam 11*d* parallel, and laterally displaced, upward. The amount of displacement changes by twice the amount X1 of the shear of the frame as shown in FIG. 2*a*. Fastened on the crosshead 2 as detector is the photo-sensitive line sensor or line camera 11*c*. By this means, the horizontal displacement of the reflected light beam 11*d* is measured. The line camera 11*c* generates a signal that is proportional to the shear X1 of the frame, and which can be used in a feedback control system to reduce the shear of the frame.

To improve the damping of vibrations, further measurements of the deformation of the frame in the "y" direction are possible. Generally, these are not necessary, because in the "y" direction the frame is very rigid, but this is not always necessarily the case. Furthermore, the existing acceleration sensors ac2, ac4, ac6, and ac8 already allow measurement of the twist of the frame about the vertical axis ("z" axis).

The deformations can also be measured on lower mounts 6 and/or on upper mounts 7 of the car body 5 (FIG. 1). The measurement can take place along one, two, or all three axes. For this purpose, distance or position sensors using magnetic field measurement, or inductive or capacitive measurement principles, are suitable.

As an alternative to measuring the deformation on the mounts 6 and/or 7 of the car body 5, additional acceleration sensors on the car body 5 are possible. The number of acceleration sensors needed is the same as the number of additional degrees of freedom needing to be controlled.

With the actuators that act on the guide elements, not all structural resonances which occur on the car body can be damped, even if enough good measurements are available. If necessary, further actuators can be used. Positions well suited for arranging the actuators are the mounts 6 and 7. The actuators can be arranged parallel to, or in series with, or completely replace, the elastic mounts 6 and 7, which take the form of vibration isolation, these actuators being capable of acting along one, two, or all three axes. Very suitable for this purpose are so-called active engine mounts, such as are used on motor vehicles to support the engine.

For example, The U.S. Pat. No. 4,699,348 (incorporated herein by reference) discloses an active engine mount which consists of a passive rubber spring and an electromagnetic actuator. The actuator serves mainly to damp low-frequency resonant vibrations, while the soft rubber spring with less damping acts as good vibration isolation in the higher frequency range.

Figure 3:
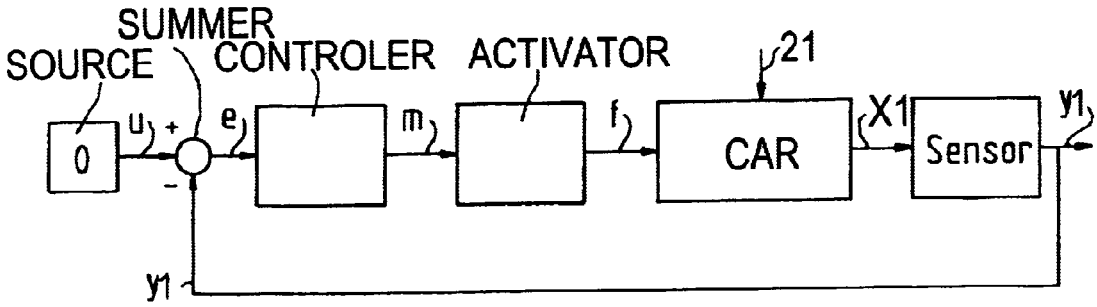
FIG. 3 is a block diagram of a feedback control system for damping lateral movements according to the present invention.

The feedback control system for damping the shearing movement of the frame is shown in FIG. 3 and includes as the main components a controller and a controlled system, the latter consisting of the actuator or actuators, the frame with the car body, and the sensor or acceleration sensors.

Interfering forces Z1 which act on the car body "Car" and are caused by the frame guides, the relative wind, and the ropes, cause inter alia the shear X1 of the car frame. A "Sensor" generates a sensor signal Y1 that behaves proportional to the shear of the frame. In a summing module "Summer", the sensor signal Y1 is subtracted from a desired value u, which in the normal case is zero (0) generated by a "Source". The result of the subtraction is a control deviation e. This control deviation is processed in a "Controller", and an actuating signal m is generated at an output. In the simplest case, the "Controller" is a proportional controller, but much more complex controller functions are also possible. The "Controller" output is connected to an input of an "Actuator" that consists, for example, of four active actuators as aforesaid. The "Actuator" generates adjusting forces f between the guide rollers, more specifically guiderails, and frame of the "Car".

The controller is designed so that the greatest amplification occurs at the first natural frequency, for example 10 Hz, of the frame with the car body. The controller has a bandpass characteristic at which the amplification at very low and very high frequencies approaches zero, so that no static forces can build up which could cause the frame and car body to rotate.

Figure 4:
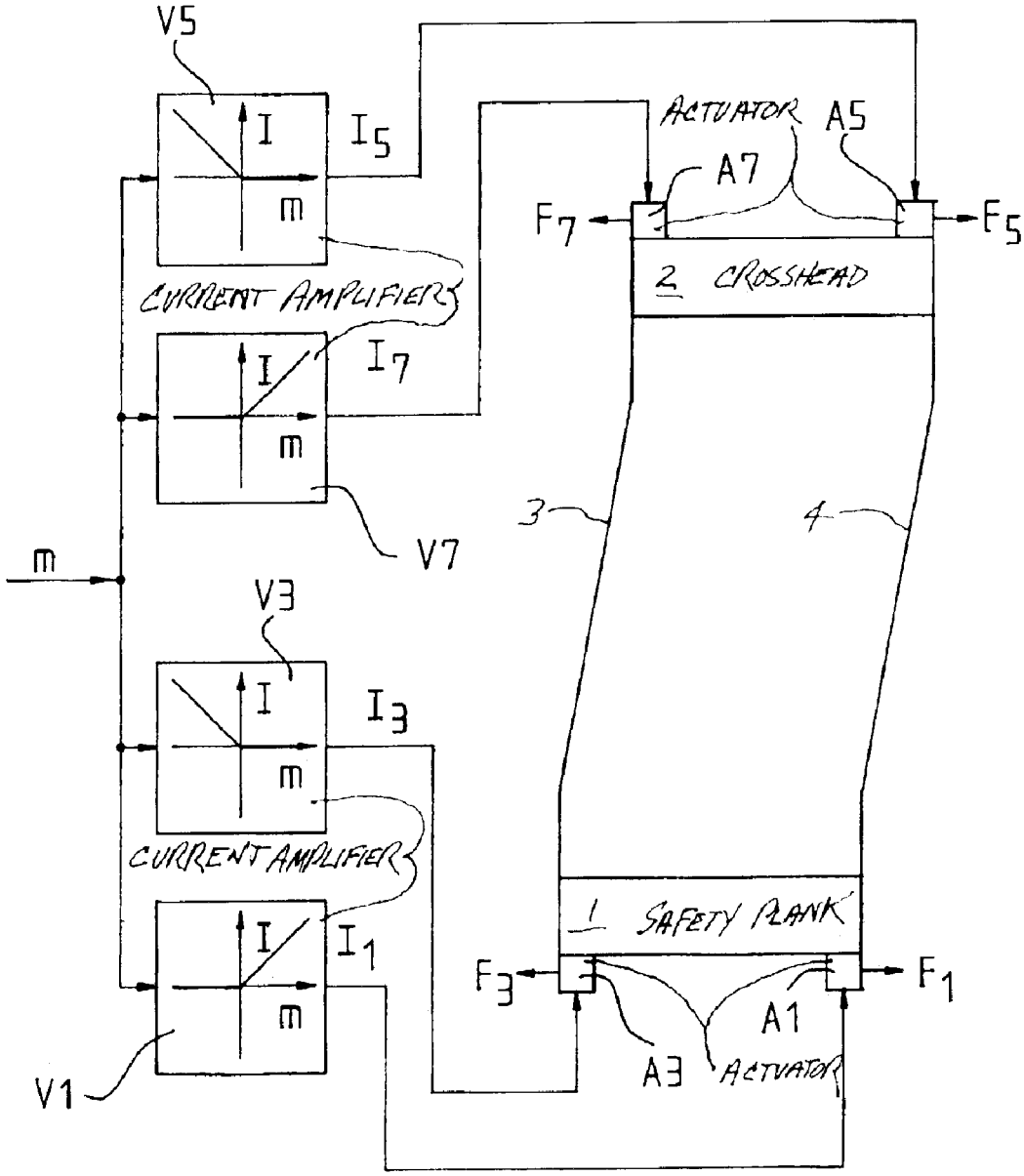
FIG. 4 is schematic diagram of an electrical actuator element of the feedback control system shown in FIG. 3.

According to FIG. 4, the active actuators are driven by the actuating signal m so that actuating forces F1, F3, F5 and F7 are generated to act against the shear of the frame. The actuating signal m is first passed to each of current amplifiers V1, V3, V5 and V7, of which one is provided for each of active actuators A1, A3, A5 and A7. Individual current functions I(m) must be selected according to the signal flow chart shown in FIG. 4, where currents I1, I3, I5 and I7 are generated for the active actuators A1, A3, A5 and A7 respectively, such that the actuators generate the actuating forces F1, F3, F5 and F7 respectively, which forces are normally proportional to the currents.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A device for damping vibrations of an elevator car frame carrying a car body and guided by guide elements on guiderails, vibrations which occur perpendicular to the direction of travel of the car being measured by acceleration sensors fastened to the frame and being used for feedback control of at least one actuator which is arranged between the frame and the guide elements and acts in the opposite direction to the vibrations, comprising:

a sensing means for sensing a shear movement of the car frame and generating a sensor signal representing a value of the shear movement; and a control device connected to said sensing means and responsive to said sensor signal for generating an actuating signal to the at least one actuator for controlling the shear movements of the car frame.

2. The device according to claim 1 wherein said sensing means includes one of acceleration sensors, wire strain gages and a laser sensor system adapted to be attached to the car frame for generating said sensor signal.

3. The device according to claim 1 wherein said sensing means includes at least two acceleration sensors adapted to be attached to the car frame.

4. The device according to claim 1 wherein said sensing means includes wire strain gages adapted to be attached to the car frame.

5. The device according to claim 1 wherein said sensing means includes a fiber optic gyro adapted to be attached to the car frame.

6. The device according to claim 1 wherein said sensing means is adapted to be attached to the car frame and includes a laser, a prism which reflects a laser beam generated by said laser, and a line sensor which senses the laser beam reflected by said prism.

7. The device according claim 1 wherein said control device includes a controller responsive to said sensor signal for generating said actuating signal and at least one current amplifier responsive to said actuating signal for generating a current to the at least one actuator, whereby said current is proportional to a force to be generated by the at least one actuator.

8. A device for damping vibrations of an elevator car frame carrying a car body and guided by guide elements on guiderails comprising:

an elevator car frame;

at least one acceleration sensor fastened to said car frame and being responsive to vibrations which occur perpendicular to the direction of travel of said car frame for generating a feedback signal;

at least one actuator arranged between said car frame and the guide elements and acting in the opposite direction to the vibrations in response to said feedback signal;

a sensing means for sensing a shear movement of said car frame and generating a sensor signal representing a value of the shear movement; and a control device connected to said sensing means and responsive to said sensor signal for generating an actuating signal to the at least one actuator for controlling the shear movements of said car frame.

9. The device according to claim 8 wherein said sensing means includes one of acceleration sensors, wire strain gages, a laser sensor system and a fiber optic gyro attached to said car frame for generating said sensor signal.

10. The device according to claim 8 wherein said sensing means is attached to said car frame and includes a laser, a prism which reflects a laser beam generated by said laser, and a line sensor which senses the laser beam reflected by said prism.

11. The device according claim 8 wherein said control device includes at least one controller responsive to said sensor signal for generating said actuating signal and at least one current amplifier responsive to said actuating signal for generating a current to the at least one actuator, whereby said current is proportional to a force to be generated by the at least one actuator.

12. A device for damping vibrations of an elevator car frame carrying a car body and guided by guide elements on guiderails comprising:

an elevator car frame;

at least one acceleration sensor fastened to said car frame and being responsive to vibrations which occur perpendicular to the direction of travel of said car frame for generating a feedback signal;

at least one actuator arranged between said car frame and the guide elements and acting in the opposite direction to the vibrations in response to said feedback signal;

a sensing means attached to said car frame for sensing a shear movement of said car frame and generating a sensor signal representing a value of the shear movement, said sensing means including a laser, a prism which reflects a laser beam generated by said laser, and a line sensor which senses the laser beam reflected by said prism; and a control device connected to said sensing means and responsive to said sensor signal for generating an actuating signal to thy at least one actuator for controlling the shear movements of said car frame.

13. The device according to claim 12 wherein said sensing means includes one of acceleration sensors, wire strain gages, a laser sensor system and a fiber optic gyro attached to said car frame for generating said sensor signal.

14. The device according claim 12 wherein said control device includes at least one controller responsive to said sensor signal for generating said actuating signal and at least one current amplifier responsive to said actuating signal for generating a current to the at least one actuator, whereby said current is proportional to a force to be generated by the at least one actuator.

* * * * *